United States Patent [19]

Chang et al.

[11] Patent Number: 5,071,271

[45] Date of Patent: Dec. 10, 1991

[54] INK RIBBON INKING DEVICE

[76] Inventors: Rong J. Chang, 2F, No. 7, Alley 11, Lane 140 Yu Cheng Street; Fu C. Wang, 2F, No. 10, Alley 5, Lane 220 Wen Der Road, both of Taipei, Taiwan

[21] Appl. No.: 506,618

[22] Filed: Apr. 9, 1990

[51] Int. Cl.[5] ..... B41J 27/10

[52] U.S. Cl. ..... 400/200; 400/202.2; 400/202.3; 400/202.4

[58] Field of Search ..... 400/197, 199, 200, 201, 400/202, 202.1, 202.2, 202.3, 202.4

[56] References Cited

U.S. PATENT DOCUMENTS

| | | | |
|---|---|---|---|
| RE. 24,854 | 8/1960 | Knight | 400/202.2 |
| 2,549,196 | 6/1948 | Harris | 400/202.1 |
| 2,695,092 | 10/1950 | Pelton | 400/202.3 |
| 2,969,865 | 5/1960 | Long | 400/200 |
| 4,390,294 | 6/1983 | Castro | 400/202.4 |
| 4,526,488 | 7/1985 | Krul | 400/202.4 |
| 4,690,576 | 9/1987 | Cory | 400/202.3 |
| 4,948,275 | 8/1990 | Kuhn et al. | 400/200 |

FOREIGN PATENT DOCUMENTS

| | | | |
|---|---|---|---|
| 3435082 | 4/1986 | Fed. Rep. of Germany | 400/202.3 |
| 1073562 | 1/1953 | France | 400/202.4 |
| 1293538 | 10/1972 | United Kingdom | 400/200 |

*Primary Examiner*—Edgar S. Burr
*Assistant Examiner*—John S. Hilten
*Attorney, Agent, or Firm*—Bucknam and Archer

[57] ABSTRACT

An ink ribbon inking device, which utilizes a motor to carry an eccentric shaft to push the core of an inking pen to move up and down permitting the ink contained in such an inking pen to intermittently flow downward, and simultaneously to drive two ink ribbon driving shafts to carry the ink ribbon of an ink ribbon cartridge to rotate. The ink ribbon of the ink ribbon cartridge is squeezed in between the eccentric shaft and the inking pen so that it is smeared with the ink during reciprocating motion of the core of the inking pen.

2 Claims, 2 Drawing Sheets

INK RIBBON INKING DEVICE

BACKGROUND OF THE INVENTION

The present invention is related to ink ribbon inking devices and more particularly to an ink ribbon inking device to automatically smear the ink ribbon of a variety of ink ribbon cartridges with ink.

In offices, typewriters, word processors, computers and printers as well as the related peripheral equipments are commonly used for preparing paper documents. To produce information in printed or typewritten form, an ink ribbon is generally required. Regular ink ribbons are individually packed in a cartridge for easy loading. The ink ribbon of a reusable ink ribbon cartridge must be smeared with ink regularly so that clear information in printed or typewritten form can be obtained. However, it is inconvenient and time consuming to smear the ink ribbon of an ink ribbon cartridge by oneself through manual operation. If it is sent to an ink ribbon cartridge distributor for re-inking, it will be costly. There have been disclosed certain kinds of ink ribbon inking devices to help people smear ink ribbons with ink. One disadvantage of the conventional ink ribbon inking devices is their complicated operational procedure. Another disadvantage of the conventional ink ribbon inking devices is that they are not applicable for use on ink ribbon cartridges of different specifications. The present invention has been accomplished under the circumstances in view. It is an object of the present invention to provide an ink ribbon inking device which is easy to operate and practical for use on a variety of ink ribbon cartridges of different specifications.

BRIEF DESCRIPTION OF THE DRAWINGS

The present invention will now be described by way of example, with reference to the annexed drawings, in which.

DETAILED DESCRIPTION OF THE PREFERRED EMBODIMENT

Figure 1:
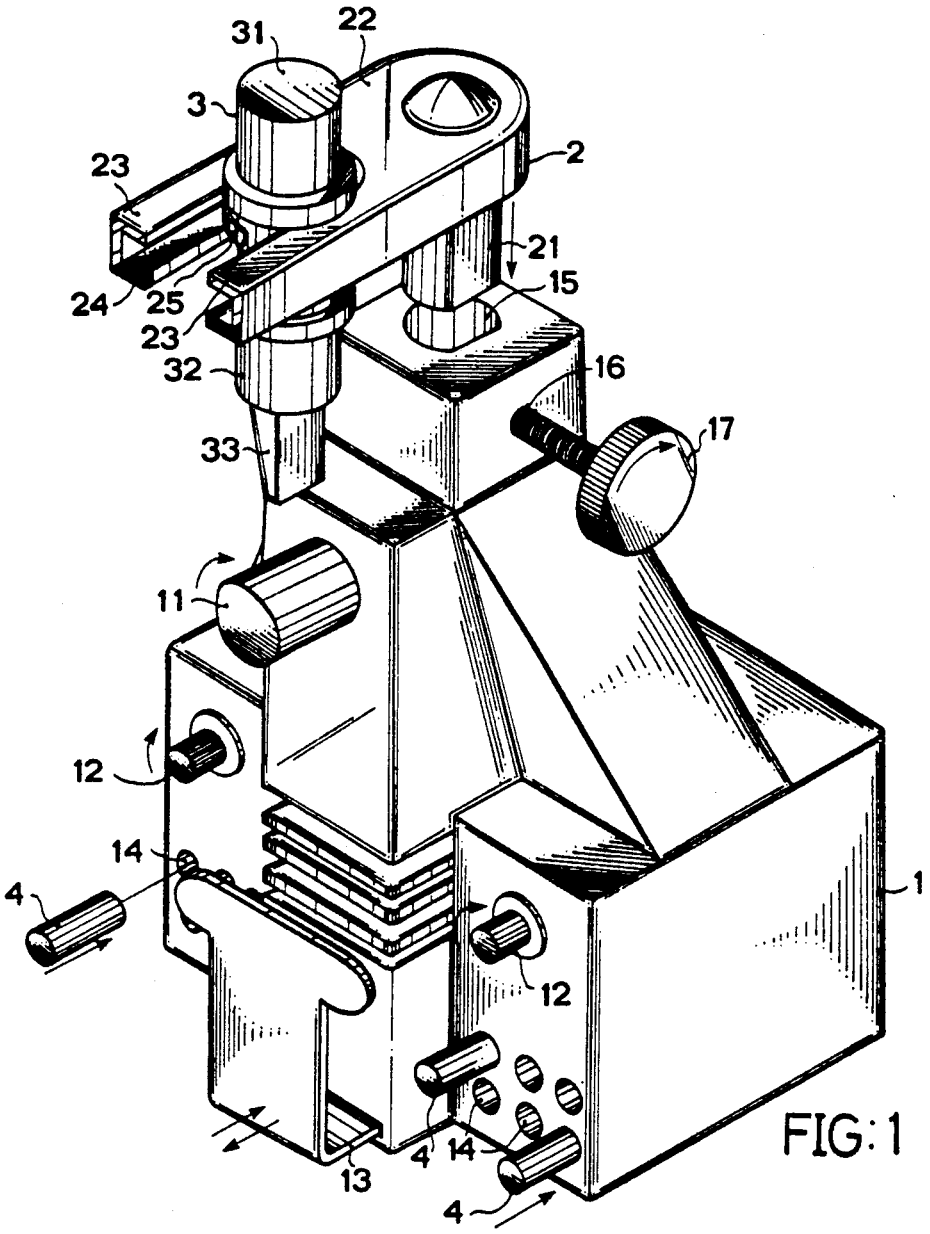
FIG. 1 is a perspective fragmentary view of an ink ribbon inking device embodying the present invention.
Figure 2:
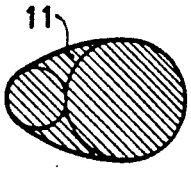
FIG. 2 is a cross sectional view of the eccentric shaft thereof.

Turning now to the annexed drawings in greater detail, there is illustrated an ink ribbon inking device in accordance with the present invention and generally comprised of a base 1, a pen rack 2, an inking pen 3, and a plurality of positioning axles 4.

The base 1 has an unitary bevel top portion extending from a rectangular bottom with a motor (not shown) set therein. An eccentric shaft 11 which has an egg-shaped cross section is pivoted to the output shaft of the motor. A belt is mounted around two ink ribbon driving shafts 12, which are inserted in the base 1 from the front side thereof, to drive the two driving shaft 12 to follow the eccentric shaft 11 to rotate synchronously. An elastic clamping member 13 is made on the front side of the base 1 for holding an ink ribbon cartridge. A plurality of positioning holes 14 are made on the base 1 below the two ink ribbon driving shafts 12 so that the positioning axles 4 can be selectively inserted therein to match with the clamping member 13 to firmly retain an ink ribbon cartridge on the front side of the base 1. A mounting hole 15 is made on the top of the base 1 for mounting the pen rack 2. The periphery of the mounting hole 15 is in an incompletely round shape having one segment cut off. A side hole 16 is made on the upper portion of the base 1 and vertically in communication with the mounting hole 15 for the fastening therein of a swivel knob 17 to firmly secure the pen rack 2 in the mounting hole 15.

The pen rack 2 is a substantially L-shaped rack having a bottom shaft 21 vertically extending downward from a clamping device 22. The bottom shaft 21 is designed in size and shape according to the mounting hole 15 so that it can be inserted therein and firmly retained by the swivel knob 17. The clamping device 22 is designed in a substantially horseshoe-like shape having two parallel channel bar portions 23 extending forward. The two parallel channel bar portions 23 have each an U-shaped cross section defining therein a channel 24 so that the inking pen 3 can be set to slide between the two parallel channel bar portions 23. An elastic, curved clamping strip 25 extends from the inner wall of each of the two parallel channel bar portions 23 for clamping up the inking pen 3.

Figure 3:
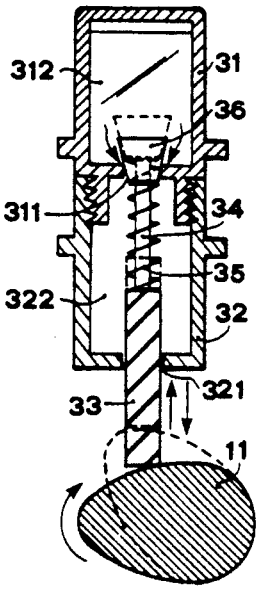
FIG. 3 is a schematic drawing illustrating the operation of the eccentric shaft to drive the core of an inking pen to move.
Figure 4:
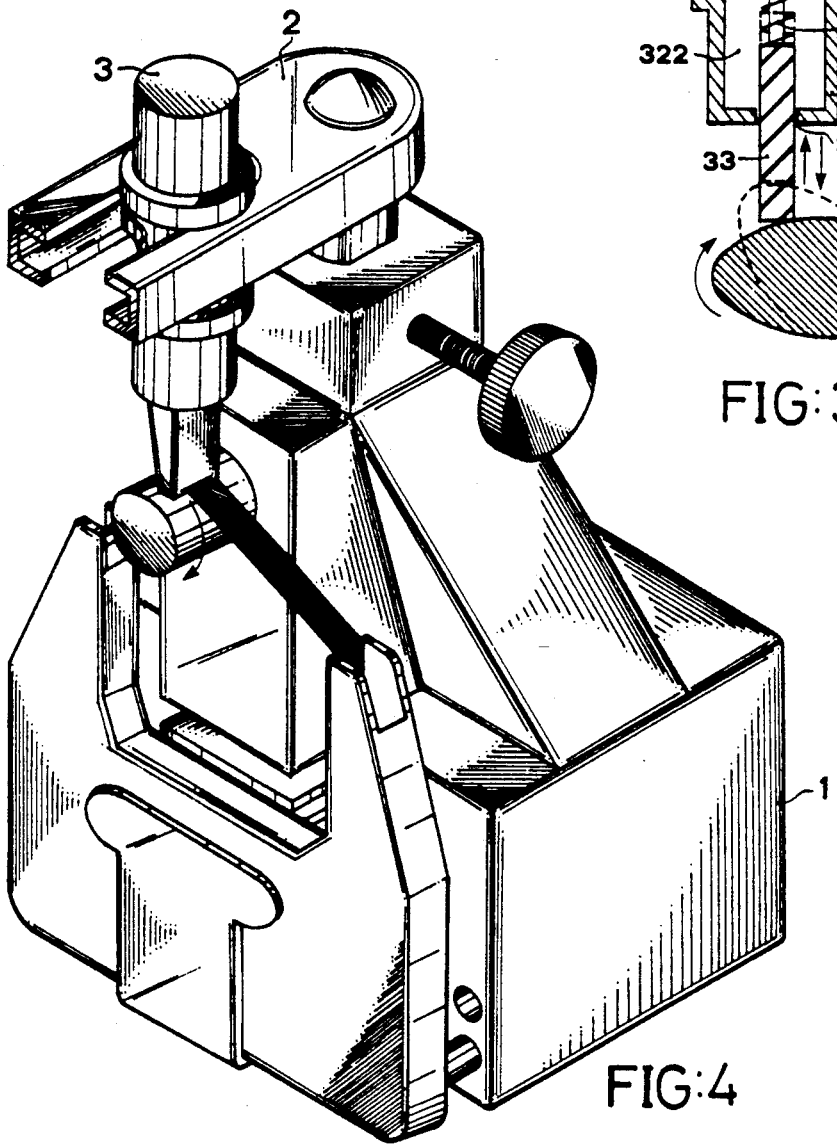
FIG. 4 is a perspective view of the present invention in which an ink ribbon cartridge is mounted for receiving ink.

As shown in FIGS. 3 and 4, the inking pen 3 is substantially a cylinder having a penholder formed of an upper part 31 and a lower part 32 respectively defining therein an upper ink chamber 312 and a lower ink chamber 322. The upper part 31 of the penholder of the inking pen 3 has a hole 311 on its bottom end for the insertion therethrough of a core 33. The core 33 has a flat bottom end and is made of water absorbing material. A mandrel 34 extends upward from the top of the core 33 and has a truncated cone 36 invertedly made on its top end serving as a stopper, which truncated cone 36 has one end in diameter larger than the hole 311 and an opposite end slightly smaller than the hole 311. A compression spring 35 is sleeved on the mandrel 34 and set between the core 33 and the stopper of truncated cone 36. The lower part 32 of the penholder of the inking pen 3 has an inking hole 321 on its bottom end and is in diameter slightly larger than the outer diameter of the upper end of the core 33 so that the core 33 is permitted to move vertically therethrough.

The positioning axles 4 are made of round rods in size according to the positioning holes 14 so that they can be selectively inserted therein with the outer ends thereof to stably support an ink ribbon cartridge.

With respect to the operation of the present invention, it is outlined hereinafter with reference to FIGS. 3 and 4. An ink ribbon cartridge is mounted on the ink ribbon driving shafts 12 and firmly clamped by the clamping member 13 with its ink ribbon winding on the eccentric shaft 11. After the inking pen 3 is firmly retained in the pen rack 2 above the base 1, the motor inside the base 1 is turned on to carry the eccentric shaft 11 and the two ink ribbon driving shafts 12 to rotate synchronously. When the pointed side of the eccentric shaft 11 is turned upward, the core 33 is pushed upward to simultaneously push the truncated cone 36 upward permitting the ink in the upper ink chamber 312 to flow into the lower ink chamber 322 to further permeate in the core 33 for smearing the ink ribbon of the ink ribbon cartridge.

An ink ribbon cartridge generally has a plurality of recessed portions on its bottom end for positioning. In order to protect an ink ribbon cartridge from inclining leftward and rightward when it is mounted on the ink ribbon driving shafts 12 and clamped by the clamping member 13, certain pieces of the positioning axles 4 can be selectively inserted in the positioning holes 14 to respectively bilaterally stopped against the bottom recessed portions of such an ink ribbon cartridge.

After the inking process is completed and the ink ribbon cartridge is removed from the ink ribbon driving shafts 12, the core 33 and the truncated cone 36 drop to respectively block up the hole 311 and the inking hole 321 so as to protect from leakage of ink.

It is to be understood that the drawings are designed for purposes of illustration only and various modifications could be made to the present invention without departing from the basic teachings thereof. The scope herein shall be deemed as defined in the claims set forth hereinafter.

We claim:

1. An ink ribbon inking device, comprising:

a base having an eccentric shaft and two ink ribbon driving shafts driven by a motor to rotate synchronously, a clamping member on its front bottom, a plurality of positioning holes bilaterally on its front side, a mounting hole on its top and a side hole vertically in communication with said mounting hole for the fastening therein of a swivel knob;

a pen rack having a bottom shaft vertically extending downward from a clamping device, said bottom shaft being inserted in said mounting hole and firmly retained by said swivel knob, said clamping device having two parallel channel bar portions extending forward, said parallel channel bar portions having each an U-shaped cross section defining therein a channel with an elastic, curved clamping strip extending from the inner wall of each of said two parallel channel bar portions;

an inking pen comprised of a penholder formed of a upper part and a lower part respectively defining therein an upper ink chamber and a lower ink chamber, said upper part having a bottom hole on its bottom end in communication with said upper ink chamber and said lower ink chamber, said lower part having an inking hole on its bottom end in communication with said lower ink chamber, a core having a mandrel extending upward therefrom with a truncated cone invertedly made on its top end serving as a stopper and with a compression spring sleeved on said mandrel and set between said core and said truncated cone, said truncated cone having one end in diameter larger than said bottom hole and an opposite end slightly smaller than said bottom hole.

2. An ink ribbon inking device as claimed in claim 1, wherein a plurality of positioning holes are bilaterally made on the front side of said base and a plurality of positioning axles are provided for insertion in said positioning holes selectively.

* * * * *